US006412409B2

(12) United States Patent
Weishew

(10) Patent No.: US 6,412,409 B2
(45) Date of Patent: Jul. 2, 2002

(54) APPARATUS AND METHOD FOR PRINTING CORRUGATED BOARD

(76) Inventor: Joseph J. Weishew, 1618 Pennsylvania Ave., Oreland, PA (US) 19075

( * ) Notice: Subject to any disclaimer, the term of this patent is extended or adjusted under 35 U.S.C. 154(b) by 0 days.

(21) Appl. No.: 09/782,904

(22) Filed: Feb. 14, 2001

Related U.S. Application Data

(63) Continuation-in-part of application No. 09/090,485, filed on Jun. 3, 1998, now abandoned.

(51) Int. Cl.[7] ..... B41F 13/08

(52) U.S. Cl. ..... 101/216; 101/479; 101/DIG. 35; 101/183

(58) Field of Search ..... 101/DIG. 35, 480, 101/479, 184, 182, 247, 484, 181, 183, 216, 180

(56) References Cited

U.S. PATENT DOCUMENTS

| | | | | |
|---|---|---|---|---|
| 2,637,270 A | | 5/1953 | Bamford | 101/157 |
| 2,925,037 A | | 2/1960 | Fischer | 101/216 |
| 3,625,145 A | | 12/1971 | Heatley, Jr. et al. | 101/152 |
| 4,046,070 A | | 9/1977 | Halley | 101/216 |
| 4,449,450 A | | 5/1984 | Barny et al. | 101/232 |
| 4,989,514 A | * | 2/1991 | Schiavi | 101/216 |
| 5,060,569 A | | 10/1991 | Gladow | 101/216 |
| 5,385,091 A | | 1/1995 | Cuir et al. | 101/217 |
| 5,490,461 A | | 2/1996 | Beaudoin | 101/483 |
| 5,590,598 A | | 1/1997 | Keller | 101/479 |
| 5,715,749 A | | 2/1998 | Miller | 101/216 |
| 6,142,073 A | * | 11/2000 | Zeman et al. | 101/216 |

FOREIGN PATENT DOCUMENTS

| | | |
|---|---|---|
| DE | 4404758 | 8/1995 |
| EP | 0 123 976 | 11/1984 |
| EP | 0 667 235 | 8/1995 |
| EP | 0 737 569 | 10/1996 |

* cited by examiner

*Primary Examiner*—Leslie J. Evanisko
(74) *Attorney, Agent, or Firm*—Drinker Biddle & Reath LLP

(57) ABSTRACT

A device for printing board or cut sections of board comprising a number of print stations through which the board is arranged to pass successively to receive print images from one or more of the print stations and at least one print station. The print station comprising a print cylinder mounted in a laterally displaceable carriage which can be moved laterally away from the board travel line, leaving in place substantially all the remaining parts of the at least one print station, to allow changing of printing plate or plates on the print cylinder while the printing apparatus can continue to operate with one or more of the other print stations.

17 Claims, 7 Drawing Sheets

APPARATUS AND METHOD FOR PRINTING CORRUGATED BOARD

CROSS REFERENCE TO RELATED APPLICATION

This is a continuation-in-part application of application Ser. No. 09/090,485, filed Jun. 3, 1998 now abandoned.

FIELD OF THE INVENTION

The present invention relates to an apparatus for printing, and more particularly to an apparatus having a displaceable print cylinder for printing on board or cut sections of board.

BACKGROUND OF THE INVENTION

Apparatus for printing on board or cut sections of board, such as corrugated board, commonly include a number of print stations through which the board is directed to successively receive print images from one or more of the print stations.

In such apparatus, each print station commonly includes a print cylinder fitted with one or more printing plates for receiving ink from, for example, an anilox roll, and for transferring appropriate print images to the board or board sections. The printing plate or plates on each print cylinder need to be replaceable to enable different printing requirements to be satisfied. The present invention is concerned with an arrangement for enabling the printing plates to be changed on one print cylinder without requiring the entire printing apparatus to be stopped.

In addition, existing apparatus typically exhaust air from their vacuum transfer table fans directly into overhead centralized take-away systems or to a bag filter. Bag filters eventually clog, and the resulting back pressure decreases the vacuum level of the transport table. This decrease in vacuum level affects the accuracy of registration from one print unit to another. The present invention incorporates a self cleaning filter unit directly on the print unit's vacuum fan's exhaust to satisfy clean air requirements for operating personnel.

SUMMARY OF THE INVENTION

According to the present invention, at least one of the print stations comprises a print cylinder mounted in a laterally displaceable carriage which can be moved laterally (in a direction parallel to the longitudinal axis of the print cylinder) away from the board travel line, leaving in place substantially all the remaining parts of the print station, to allow changing of the printing plate or plates on the print cylinder while the printing apparatus can continue to operate with one or more of the other print stations.

Each print station is preferably a top printer: that is to say, it applies print to the upper surface of the board or board sections. In a preferred arrangement for flexographic printing, the print cylinder receives ink on its printing plate or plates from an anilox roll which remains in position (except for being moved slightly away from the print cylinder) when the print cylinder carriage is displaced laterally to allow the printing plate or plates to be changed.

Each print station preferably includes conveyors, for example rollers, for conveying the board through the station, and those conveyors remain in place when the print cylinder carriage is displaced laterally. Thus the conveyors remain available to convey board through the print station so as to allow the printing apparatus to continue operating while any given print station is being altered in preparation for applying the print needed for a subsequent order.

This invention contrasts with, and is an improvement over, prior proposals, for example one providing for the entire printer or the top portion thereof to be lifted vertically to allow the operator (who must then work on an overhead gantry) to change the printing plates. Another prior proposal involved displacing laterally the entire print station; this involves a number of problems, not least of which is the fact that the printing apparatus cannot then readily be kept in operation while one of the print stations is out of position. The provision, in accordance with the present invention, for displacing essentially only the print cylinder and leaving the remainder of the printing station in position is a significant improvement over such prior proposals.

An example of a print station according to this invention is shown in the accompanying drawings.

Additional features and advantages of the invention will become apparent to those skilled in the art upon consideration of the following detailed description of the preferred embodiment exemplifying the best mode of carrying out the invention as presently perceived. The detailed description particularly refers to the accompanying drawings.

DETAILED DESCRIPTION OF THE PREFERRED EMBODIMENT

Figure 1:
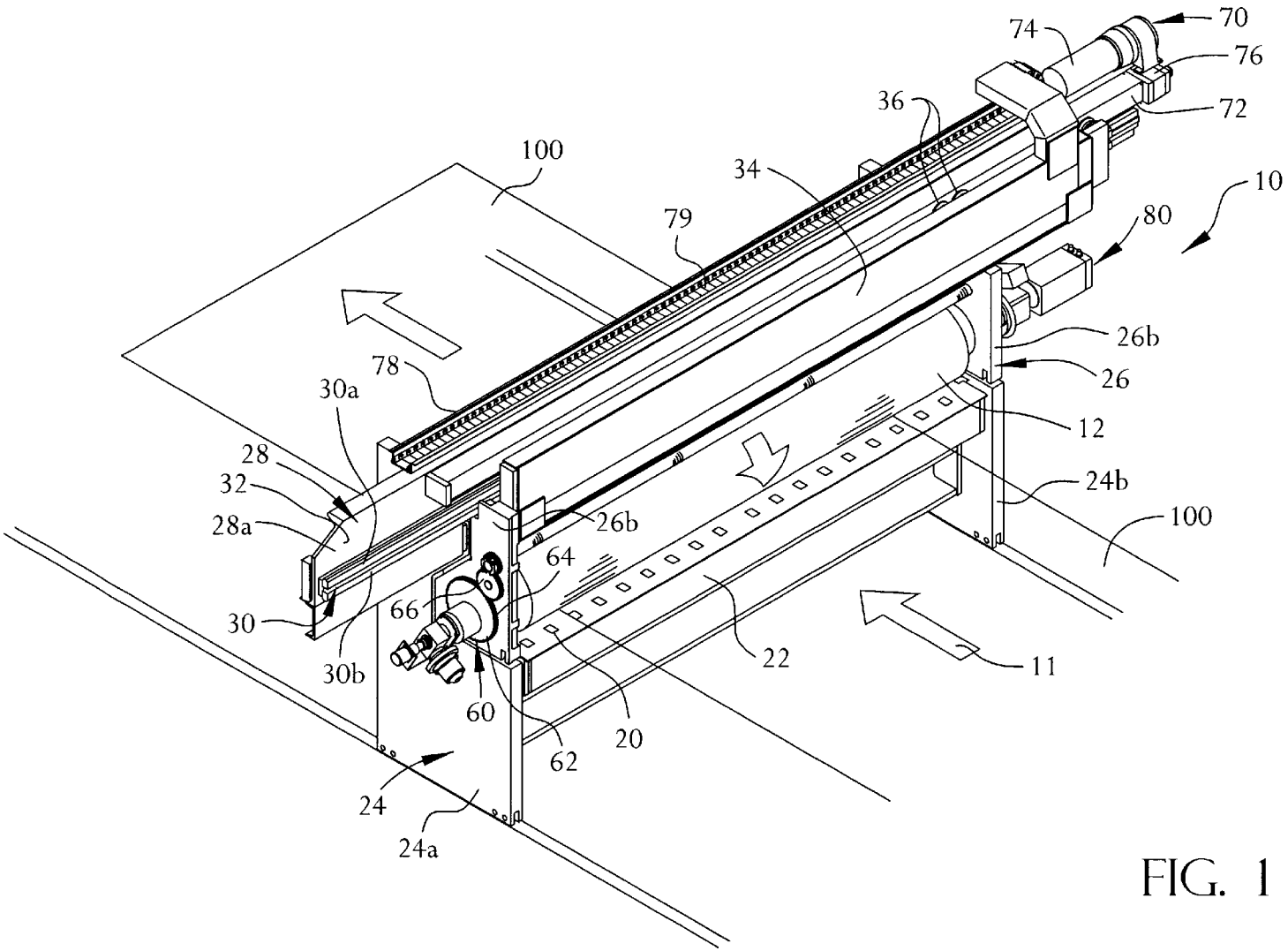
FIG. 1 is an isometric view of the print station of the present invention.

FIG. 1 illustrates a print station 10 comprising a print cylinder 12 carrying printing plates (not shown) for applying print images to corrugated board sections 100 conveyed in the direction of the arrow 11 through the print station.

Figure 2:
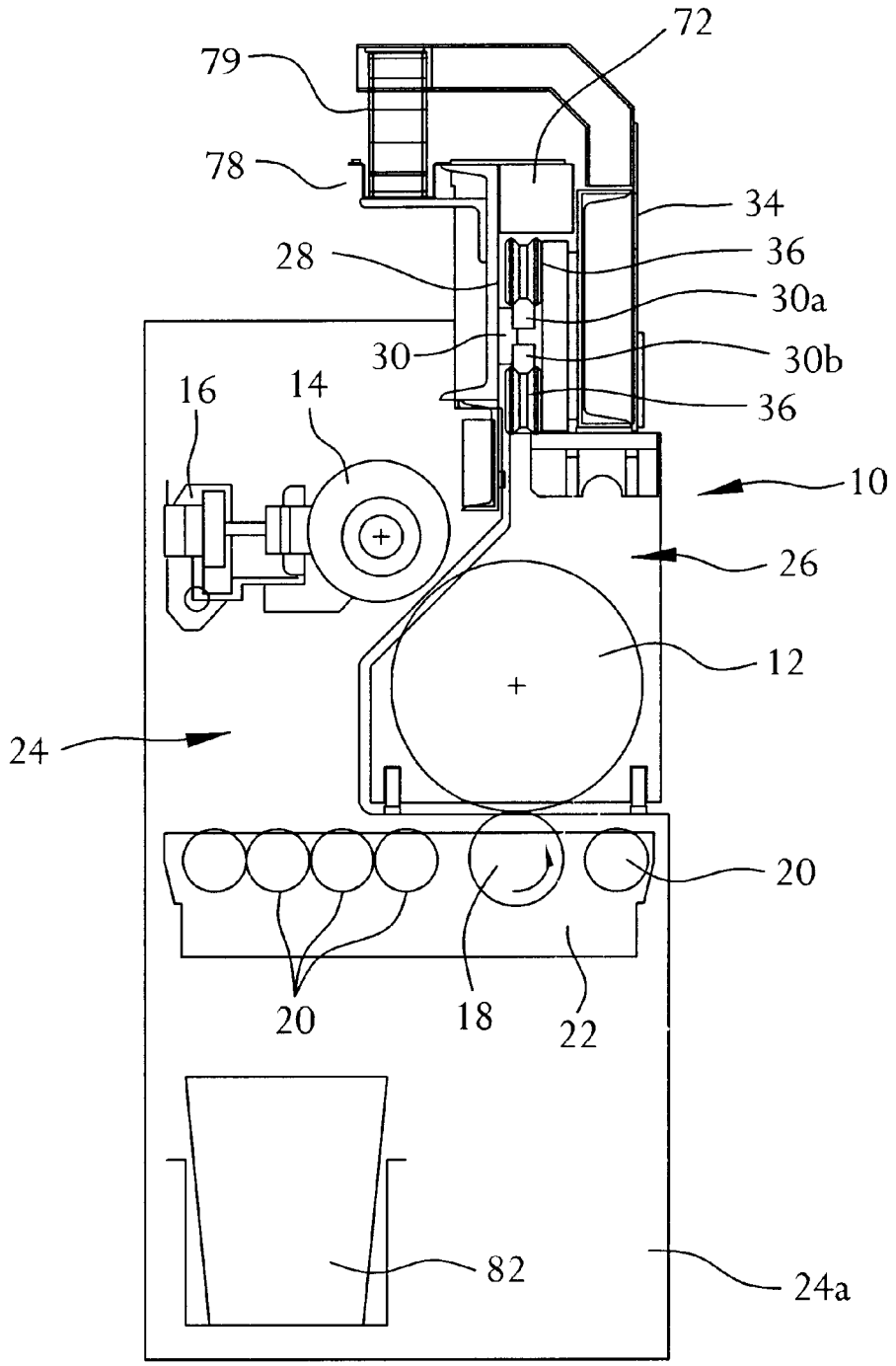
FIG. 2 is a side schematic view of the print station of FIG. 1.

Referring now to FIGS. 1 and 2, ink is applied to the printing plates by means of an anilox roll 14 which is uniformly coated with ink by means of a chambered doctor blade assembly 16. An impression roll 18 located below the print cylinder 12 holds the moving board sections 100 against the printing plates on the print cylinder 12. A plurality of rolls 20 are also provided for conveying the board sections 100 through the print station 10. The conveying rolls 20 are mainly located in a suction chamber 22 whereby suction in the chamber 22 draws the board section 100 downwards into driving engagement with the rolls 20.

It is contemplated that a different conveyor arrangement may be utilized. For example, the conveyor system may involve rolls above the board line and a vacuum chamber above the board line for drawing the board sections upwards into engagement with the conveying rolls.

Figure 4:
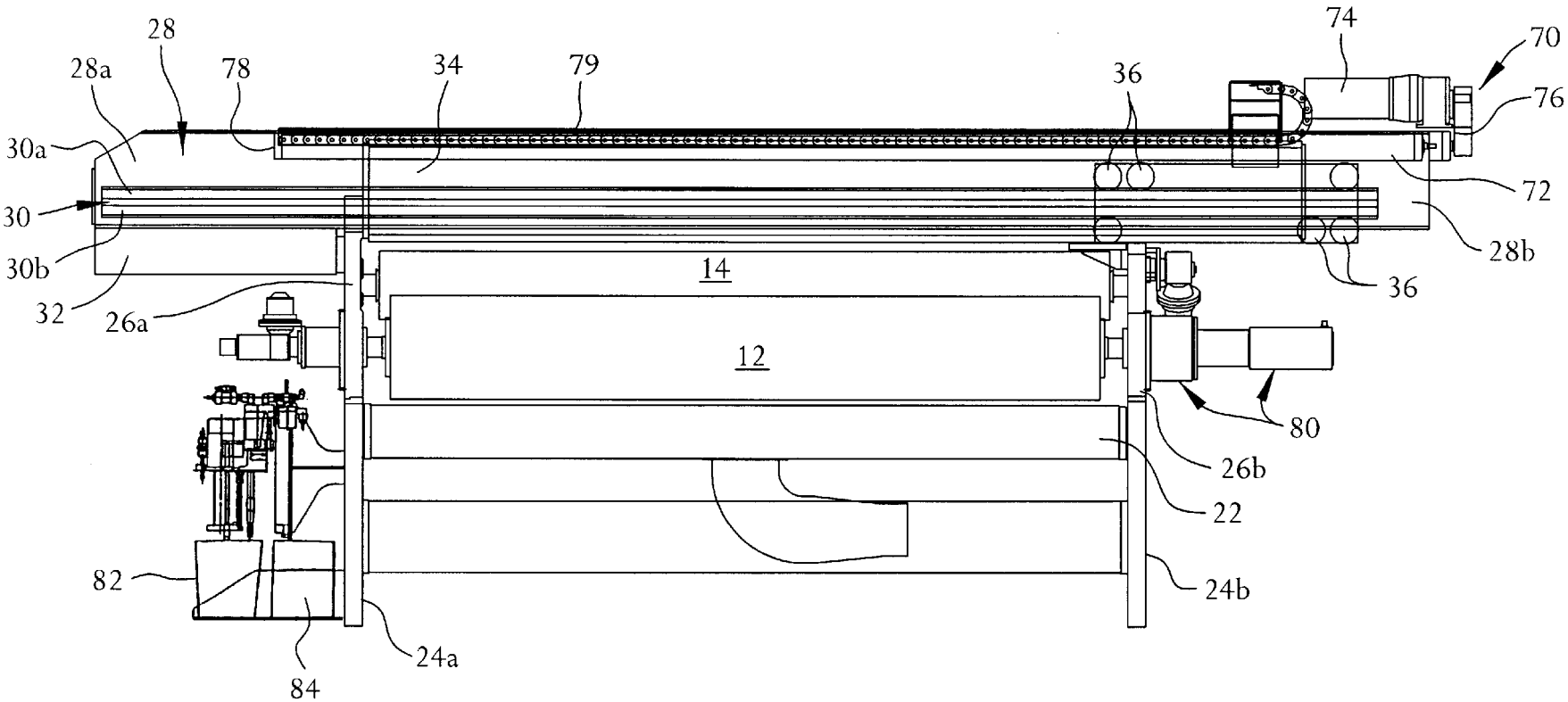
FIG. 4 is a front view of the print station of FIG. 1.

The print station 10 comprises a main frame 24 and a displaceable print cylinder carriage 26. The main frame 24 includes an operator side sub-frame 24*a* and drive-side sub-frame 24*b*. A transverse bracket 28 connects operator-side sub-frame 24*a* and a drive-side sub-frame 24*b*. As best seen in FIG. 4, each end 28*a* and 28*b* of the transverse bracket 28 overhangs beyond both the respective sub-frames 24*a* and 24*b* . The suction chamber 22, impression roll 18, rolls 20, anilox roll 14, and the chambered doctor blade 16 are carried by the main frame 24.

As best seen in FIGS. 1 and 2, a guide rail 30 is mounted on the front face 32 of the main frame bracket 28 and extends substantially the entire length thereof. The rail 30 comprises upper 30*a* and lower 30*b* tracks.

The print cylinder 12 is mounted in the print cylinder carriage 26. The carriage 26 includes an operator-side sub-frame 26*a* and a drive-side subframe 26*b* . A bracket 34 is secured to the top of the carriage 26, extending the entire length of the print cylinder 12. As best seen in FIG. 4, the bracket 34 carries an upper and a lower row of spaced wheels 36. The upper row of wheels engage with and travel along the upper track 30*a* while the lower row of wheels 36 engage with and travel along the lower track 30*b* . The wheel and track configuration enables the carriage 26 to be displaced laterally to carry the print cylinder 12 clear of the board line: that is to say, to the position shown in FIG. 5. The wheels 36 may have V-shaped peripheral cross-sections and in that case the tracks 30*a* and 30*b* would have corresponding V-sectioned grooves for locating the wheels.

Figure 3:
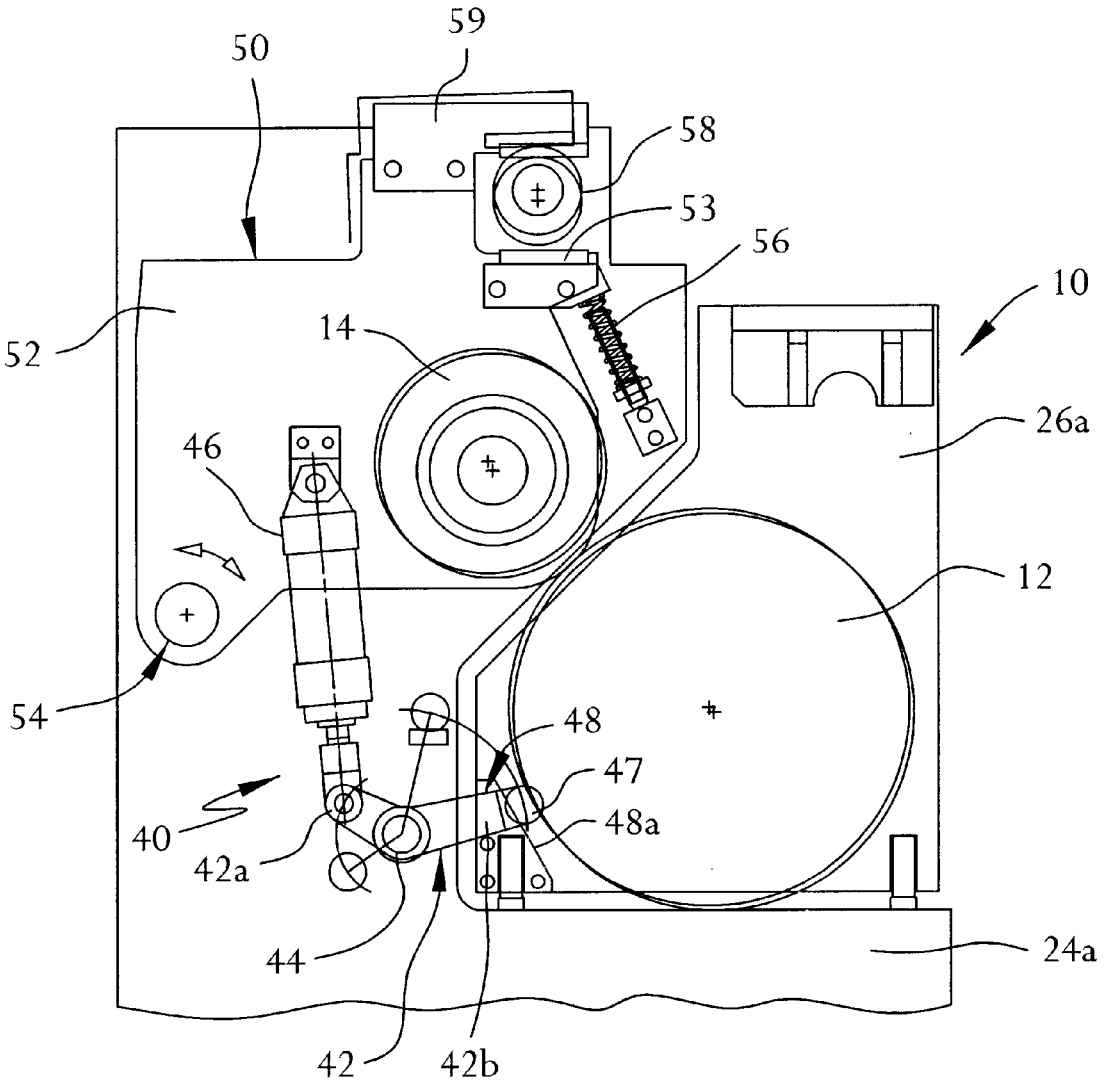
FIG. 3 is a enlarged partial schematic side view of the upper portion of the print station of FIG. 1.

As best seen in FIG. 3, when the print cylinder 12 is in position above the board line (FIG. 1), the carriage 26 may be secured to the main frame 24 by a clamping device 40 mounted on each sub-frame of main frame 24. The clamping device 40 includes a pivoting lever 42 mounted to the main frame 24 at pivot 44. An actuator 46 is connected to one end 42*a* of the lever 42. A cam follower 47 is located on the other end 42*b* of the lever 42. An inclined ramp 48 is located on each lower inner corner of the frame 26 such that the inclined surface 48*a* of the ramp 48 is engageable by the cam follower 47. To clamp the carriage 26 on the main frame 24, the actuator 46 is retracted, pivoting the lever 42 about pivot 44. The follower 47 engages the inclined surface 48*a* of the ramp 48, applying both a horizontal and a vertical force to the ramp 48 to secure the carriage 26 to the main frame 24. The clamping device 40 is released by extending the piston rod of the actuator 46. When the clamping device 40 is released the print cylinder carriage 26 may be displaced laterally to allow for printing plate changing.

Before the carriage 26 can be displaced laterally it is necessary to lift the print cylinder 12 clear of the impression cylinder 18. It is also necessary to lift the anilox cylinder 14 clear of the print cylinder 12 before the print cylinder can be lifted from the impression cylinder 18. An anilox roll lifting device 50 is incorporated in the main frame 24 and a print cylinder lifting device 60 (FIG. 1) is incorporated in the carriage 26 to accomplish these functions.

As best seen in FIG. 3, the anilox lifting device 50 comprises a frame 52 pivotably attached to the main frame 24 at pivot 54. The anilox roll 14 is mounted on the pivotable frame 52. A spring 56 located on the main frame 24 biases the pivotable frame 52, and the anilox roll 14, away from the print cylinder 12. An eccentric 58 is rotated to force the pivotable frame 52 against the spring 56 such that the anilox roll 14 is engaged with the print cylinder 12.

A releaseable lock member 59 is provided to secure the pivotable frame 52 in an operating position in which the anilox roll 14 is engaged with the print cylinder 12. In the operating position, the eccentric 58 is rotated until its thickest portion is in contact with contact pads 53 on frame 52 to force the frame 52 against the spring 56 and engage the anilox roll 14 with the print cylinder 12. The locking member 59 is clamped against the eccentric 58 by means of a hold-down cylinder (not shown) to secure the frame 52 in the operating position.

When it is necessary to displace the print cylinder carriage 26 laterally, the anilox roll 14 must be lifted off the print cylinder 12. To accomplish this, the locking member 59 is disengaged from the eccentric 58. The eccentric 58 is then rotated until its thinnest portion is engaged with the contact pads 53. This permits the frame 54 to pivot away from the print cylinder 12 under the force of the spring 56. In this position there is sufficient clearance between the anilox roll 14 and the print cylinder 12 to allow the carriage 26 to be displaced laterally, as explained in greater detail below.

It should also be recognized that the eccentric 58 can be rotated to an intermediate position in which the anilox roll 14 is disengaged to a lesser degree from the print cylinder 12, permitting a jam to be cleared or the print cylinder 12 to be cleaned.

The print cylinder lifting device 60 is best seen in FIG. 1 and comprises an eccentric 62 on which the print cylinder 12 is mounted. The periphery of the eccentric 62 has a toothed surface 64. A series of gears 66 engage the toothed surface 64 of the eccentric 62. The gears 66 are driven to rotate the eccentric 62 and lift the print cylinder 12 from the impression cylinder 18. In this raised position, the print cylinder carriage 26 can be displaced laterally.

A drive device 70 is provided for displacing the print cylinder carriage 26 laterally. The drive device 70 comprises a linear actuator 72 mounted to the bracket 28 of the main frame 24. The linear actuator 72 is preferably in the form of a telescoping slide. The linear actuator 72 is driven by a drive motor 74 through a gear reducer 76. The linear actuator is coupled to the bracket 34 of the frame 26. The drive motor 74 extends and retracts the linear actuator 72, displacing the print cylinder carriage 26 laterally from the operating position shown in FIG. 1 to the fully displaced configuration shown in FIG. 5. In the fully displaced position, the print cylinder carriage 26 is cantilevered on the end 28*a* of the main frame bracket 28. The drive motor 74 is torque-limited to provide a beneficial safety feature. The motor 74 will stall when resistance to movement is applied to the carriage 26, for example in the event that the carriage were to encounter an obstruction such as a person, during displacement of the carriage. The drive device 70 also includes a reversing contactor, which provides for alternative extension or retraction of the linear actuator 72 by drive motor 74. A suitable motor for drive motor 74 is the Reliance Electric DC drive Model 1DN1001, made by Rockwell Automation of Greenville, S.C.

A wire raceway 78 is provided for containing the various electrical wires for the print cylinder carriage 26. The electrical wires are located in a flexible wire harness 79 which lays in the raceway 78. As the print cylinder carriage 26 is displaced laterally, the wire harness 79 progressively bends and doubles over itself allowing the electrical wires contained therein to follow the printing cylinder carriage 26 without risk of tangling, kinking, or accidental breaking. When the print cylinder carriage 26 is retracted, the wire harness 79 is returned back into the raceway 78.

It is contemplated that a pair of sensors may be provide to assist in retracting the print cylinder carriage 26. The sensors (not shown) can be used to enable the slowing down of the linear actuator drive in order to slow down the carriage 26 down just before reaching the operational or fully retracted position. The sensors can also be used to signal when the carriage reaches the home position so the carriage lock down mechanism 40 can be actuated to secure the carriage 26 to the main frame 24.

Figure 5:
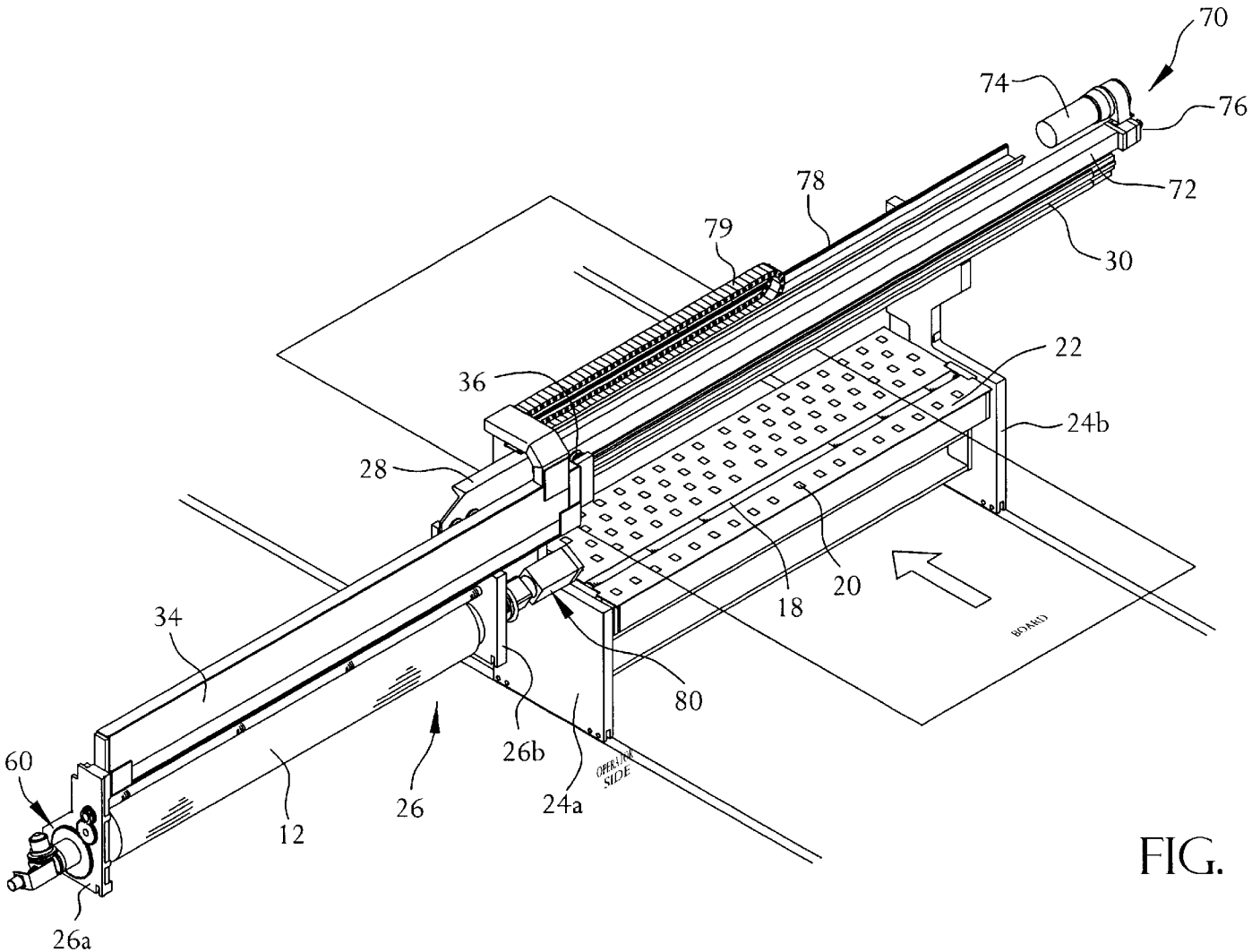
FIG. 5 is an isometric view of the print station of FIG. 1 showing the print cylinder carriage in the laterally displaced position.

As shown in FIG. 1, the print cylinder 12 has an associated drive motor 80 which is an independent drive such as a servo motor for rotating the print cylinder. The motor 80 preferably remains connected to the print cylinder 12 when the carriage 26 is displaced laterally, as shown in FIG. 5. Preferably, when the print cylinder is not in the down and ready-to-run condition, a contactor of the drive motor 80 is de-energized to ensure against inadvertent cylinder rotation, for operator safety. However, the drive motor 80 can be "jogged" in a low torque mode when not in the down and ready-to-run condition to slowly rotate the cylinder 12 forward and reverse. The ability to jog the cylinder 12 facilitates changing of die plates or other cylinder maintenance, for example. The cylinder 12 may be jogged while the carriage is lifted with the carriage in the retracted condition. Alternatively, the cylinder can also be jogged after the carriage has been displaced laterally to the cantilevered position previously described. As an additional safety feature, the cylinder drive motor 80 is torque-limited to provide for stalling of the motor and stoppage of the cylinder when resistance to rotation is applied the cylinder, for example by the hand of an operator.

The conveyor rolls 20 may also have an independent drive; that is to say, independent of the drive (not shown) to the anilox roll 14 and of the drive 80 to the print cylinder 12. The drive for the rolls 20 of each print station may be controlled to ensure proper registration of the print images applied to the board sections at successive print stations.

FIGS. 2 and 4 also show an ink pail 82 from which, during printing, ink is pumped into the ink chamber of the assembly 16. Adjacent to the pail 82 there is a container 84 for holding washing liquid. A washing operation may be carried out on the anilox roll 14 by pumping washing liquid into the chamber of the assembly 16 while the print cylinder carriage 26 is in the laterally displaced position for printing changing purposes. Separate washing provisions may be provided for the printing plates on the cylinder 12.

For the sake of lightness, the print cylinder 12 may comprise mainly a composite non-metallic material.

Figure 6:
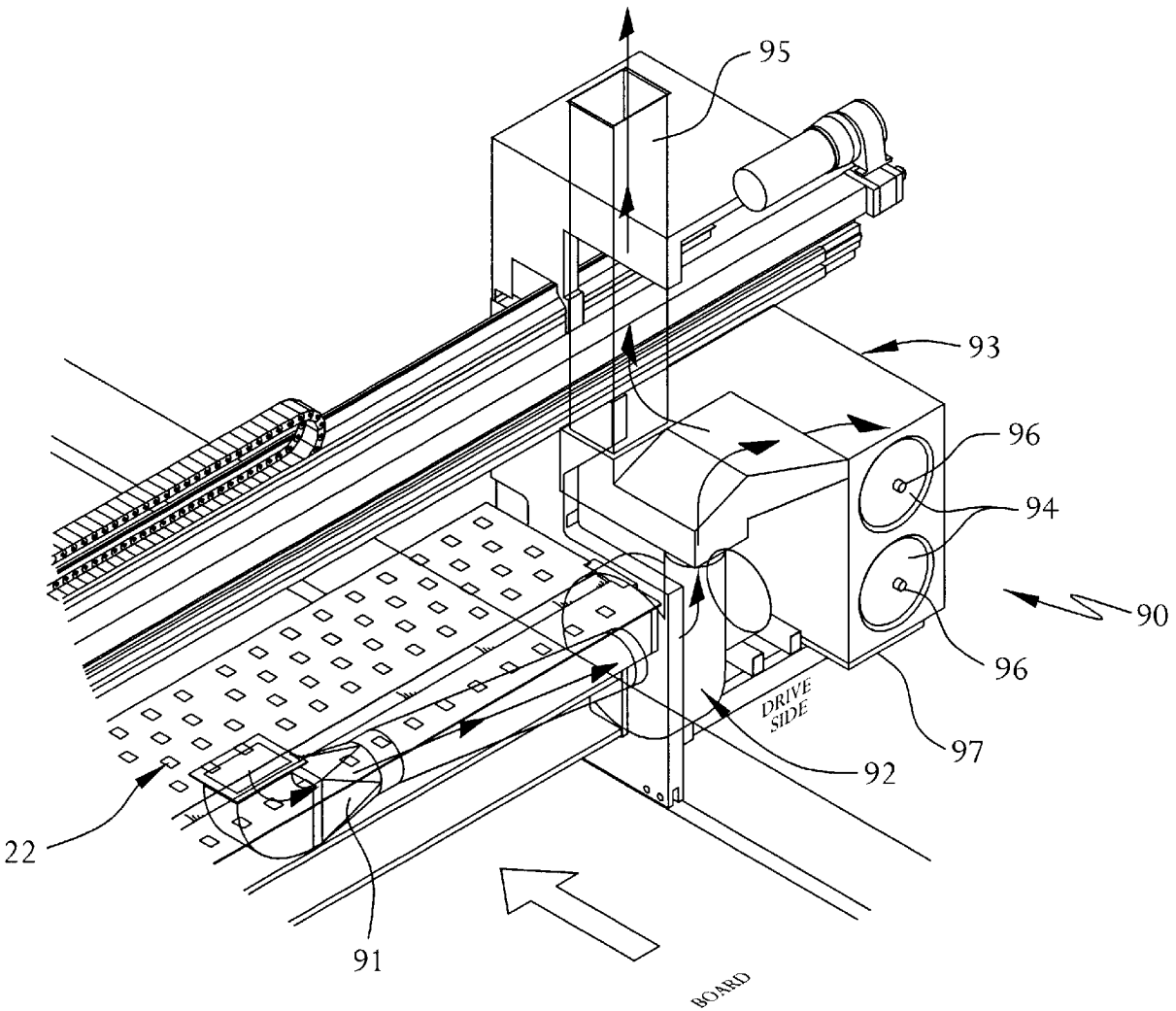
FIG. 6 is a enlarged partial isometric view of the dust collection system of the print station of FIG. 1.

In FIG. 6 there is shown a dust collection apparatus 90 in combination with the print station 10 of the present invention. It should be understood that the dust collection apparatus 90 can be adapted for use in many different types of corrugated box making machinery and is not limited to the embodiment disclosed herein. The dust collection apparatus extracts dust from the exhaust air of the vacuum transfer table 22. In order to provide vacuum level at the wheel surface of the transport table 22, air is extracted through an inlet duct 91 by a fan 92. The air is exhausted into a dust collection system 93.

In side the dust collection system 93, the air is pushed through filters 94 where dust is removed and expelled out of a silencer 95. At a sequence time throughout the operation, rotating nozzles 96 located inside the filters 94 are powered by high pressure air which blows collected dust off the surface of the filters 94. This airborne dust eventually settles into a removable dust pan 97. This "self cleaning" filter sequence eliminates the back pressure produced by "clogged" filters and keeps the vacuum level at the transport table 22 at a maximum condition. By incorporating a self-cleaning filter system 93 directly on the print unit's 10 vacuum fan's exhaust, air is cleaned of dust and expelled directly into the plant without the inconvenience of coupling to a central system or the inefficiency of using a bag filter arrangement.

Figure 7:
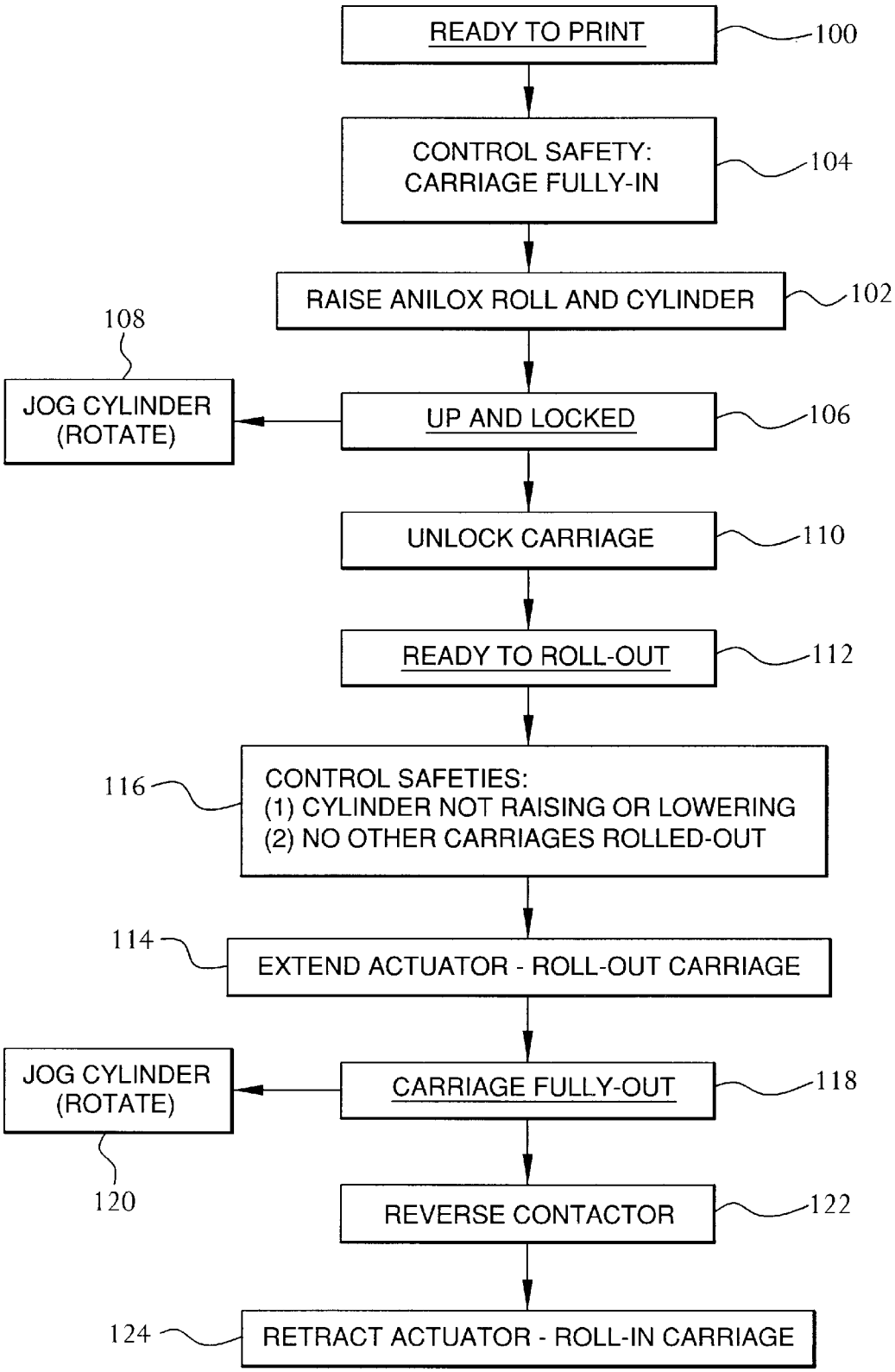
FIG. 7 is a flow chart illustrating a preferred method of operating an apparatus incorporating the print station of FIGS. 1–6.

The preferred method of operating the print station 10 of FIGS. 1–6 is best understood with reference to the flow diagram of FIG. 7. As described previously, devices for printing on board material, such as corrugated board, typically include a series of print stations arranged for sequentially printing on a length of board that is directed through the series of print stations. Accordingly, in the preferred method of operating the print station 10, the print station is operated as part of a device having a series of print stations. The device preferably includes a control system which governs the lateral displacement for each of the print cylinders and coordinates the series of print stations in the manner to be described.

In the "ready to print" condition 100, the actuator is retracted so that the carriage 26 is in the fully-in position, with the carriage clamping devices 40 locking the carriage 26 to the frame 24. The cylinder 12 and anilox roll 14 are in their lowered positions to position the print cylinder 12 for contact with the corrugated board to be printed. When roll-out of the print cylinder 12 of print station 10 is desired, the initial step 102 is to raise anilox roll 14 and print cylinder 12 in the manner described previously. However, before anilox roll 14 and print cylinder 12 can be raised, a safety 104 of the control system requires that the carriage be in the fully-in position. The position of carriage 26 could be verified, for example, by a proximity switch between the carriage 26 and frame 24 to provide a signal to the control system to indicate that the carriage is in the fully-in position.

Once the carriage 26 is in the fully-in position, it can be moved to an "up and locked" position 106. In the up and locked position, the anilox roll 14 and print cylinder 12 have been raised and the clamp device 40 remains engaged to the carriage 26. With the carriage 26 in the up and locked position, print cylinder 12 may be rotated intermittently, or "jogged" as shown at 108, to perform die plate changing or other cylinder maintenance, for example, which does not require roll-out of the carriage 26.

When it is desired to roll out the carriage, the clamp device 40 is disengaged from the carriage 26, as illustrated in step 110, to unlock the carriage and place the print station 10 in a "ready to roll out" condition 112.

To roll out the carriage 26, as illustrated in step 114, the carriage drive motor 74 is energized to extend actuator 72 to roll out carriage 26. However, another control safety 116 prevents roll-out of the cylinder carriage 26 if the cylinder is in the process of being raised or lowered. As an additional control safety, the control system will not allow carriage roll-out if any other print station has a carriage that is not in its fully-in position.

In a "carriage fully-out" condition 118, the actuator 72 has been extended such that the carriage 26 is cantilevered from the print station frame 24 as shown in FIG. 5. In the fully-out condition 118, the print cylinder drive 80 can be jogged to slowly rotate the print cylinder 12 as indicated in optional step 120.

To return the carriage 26 to the "ready to roll-out" condition 112, the contactor of carriage drive motor 74 is reversed (step 122) such that energization of the carriage drive motor 74 results in retraction of the actuator 72 (step 124).

The present invention may be embodied in other specific forms without departing from the spirit or essential attributes thereof and, accordingly, reference should be made to the appended claims, rather than to the foregoing specification, as indicating the scope of the invention.

What is claimed is:

1. An apparatus for printing board, comprising:

a number of print stations arranged to provide for successive passage of the board along a board travel line to receive print images from the print stations; and wherein at least one of the print stations comprises an elongated cylinder disposed above the board travel line and adapted to carry at least one printing plate to apply the print images to an upper surface of the board, the elongated cylinder mounted in a moveably supported carriage capable of lateral displacement to a position in which the cylinder is cantilevered from the at least one print station, leaving the at least one print station operative for continued passage of the board along the board travel line.

2. The apparatus according to claim 1 wherein the at least one print station further comprises at least one board conveying roller arranged for engagement with a lower surface of the board, and wherein the board conveying roller remains in position with respect to the at least one print station during lateral displacement of the carriage.

3. The apparatus according to claim 2 wherein the at least one print station further comprises a suction chamber arranged to facilitate engagement between the at least one board conveying roller and the board and wherein the suction chamber remains in position during lateral displacement of the carriage.

4. The apparatus according to claim 1 wherein the at least one print station further comprises elongated guides and wherein the carriage comprises wheels arranged to run along the guides to provide for the lateral displacement of the carriage.

5. The apparatus according to claim 4 wherein the print cylinder comprises an independent motor drive which moves with the cylinder upon lateral displacement of the carriage, the independent motor drive capable of rotating the cylinder while the cylinder is cantilevered from the at least one print station.

6. The apparatus according to claim 5 wherein the cylinder motor drive is torque-limited to provide for stalling of the motor drive in the event resistance to rotation is applied to the cylinder.

7. The apparatus according to claim 1 wherein the at least one print station further comprises a linear actuator adapted to engage the carriage to provide for lateral displacement of the cylinder upon extension of the linear actuator.

8. The apparatus according to claim 1 wherein the carriage further comprises a cylinder lifting device adapted to provide for raising and lowering of the cylinder with respect to the carriage.

9. The apparatus according to claim 8 wherein the at least one print station further comprises an anilox roll adapted to supply printing ink to the cylinder and wherein the at least one print station further comprises an anilox roll lifting mechanism adapted to raise and lower the anilox roll with respect to the at least one print station to facilitate the raising and lowering of the print cylinder.

10. The apparatus according to claim 7 wherein the at least one print station includes a carriage drive motor adapted to engage the linear actuator to provide for the extension of the actuator and wherein the carriage drive motor is torque limited to provide for stalling of the carriage drive motor in the event the moving carriage encounters an obstruction.

11. The apparatus according to claim 7 wherein the at least one print station includes a carriage drive motor adapted to engage the linear actuator, the drive motor comprising a reversing contactor to provide for alternative extension or retraction of the linear actuator.

12. The apparatus according to claim 1 wherein the at least one print station further comprises a carriage clamping device adapted to engage the carriage and lock the carriage in position with respect to the at least one print station.

13. The apparatus according to claim 1 further comprising a control system adapted to control the lateral displacement of the at least one print cylinder carriage, the control system verifying that none of the print stations has a laterally displaced carriage before permitting lateral displacement of a prior cylinder carriage.

14. The apparatus according to claim 13 wherein the carriage comprises a cylinder lifting device for raising and lowering of the cylinder with respect to the carriage and wherein the control system prevents lateral displacement of the carriage in the event the cylinder is being raised or lowered by the cylinder lifting device, the control system further preventing operation of the cylinder lifting device in the event the carriage is laterally displaced from the at least one print station.

15. A method of printing board comprising:

providing a number of print stations arranged to provide for successive passage of the board along a board travel line to receive print images from the print stations, at least one of the print stations comprising an elongated cylinder disposed above the board travel line and adapted to carry at least one printing plate to apply the print images to an upper surface of the board, the elongated cylinder mounted in a moveably supported carriage capable of lateral displacement to a position in which the cylinder is cantilevered from the at least one print station leaving the at least one print station operative for continued passage of the board along the board travel line; and laterally displacing the carriage of one of the print stations.

16. The method according to claim 15 further comprising the step, prior to the step of laterally displacing the carriage, of verifying that none of the print stations has a laterally displaced carriage.

17. The method according to claim 16 wherein the carriage comprises a cylinder lifting device for raising or lowering of the cylinder with respect to the carriage, and wherein the method comprises the step, prior to the step of laterally displacing the carriage, of raising the cylinder with respect to the carriage, the method further comprising the step, prior to the step of raising the cylinder, of verifying that the carriage is not laterally displaced with respect to the at least one print station.

* * * * *